US010243249B2

(12) United States Patent
Weiss

(10) Patent No.: US 10,243,249 B2
(45) Date of Patent: Mar. 26, 2019

(54) MULTI-STAGE BROADBAND DIRECTIONAL COUPLER

(71) Applicant: KATHREIN-WERKE KG, Rosenheim (DE)

(72) Inventor: Frank Weiss, Samerberg (DE)

(73) Assignee: Kathrein SE, Rosenheim (DE)

( * ) Notice: Subject to any disclaimer, the term of this patent is extended or adjusted under 35 U.S.C. 154(b) by 0 days.

(21) Appl. No.: 15/127,551

(22) PCT Filed: Feb. 26, 2015

(86) PCT No.: PCT/EP2015/000451
§ 371 (c)(1),
(2) Date: Sep. 20, 2016

(87) PCT Pub. No.: WO2015/139813
PCT Pub. Date: Sep. 24, 2015

(65) Prior Publication Data

US 2017/0141451 A1 May 18, 2017

(30) Foreign Application Priority Data

Mar. 20, 2014 (DE) ..... 10 2014 004 007

(51) Int. Cl.
*H01P 5/18* (2006.01)
*H01P 3/08* (2006.01)
*H01P 5/08* (2006.01)

(52) U.S. Cl.
CPC ..... *H01P 5/183* (2013.01); *H01P 5/187* (2013.01); *H01P 5/085* (2013.01)

(58) Field of Classification Search
CPC ..... H01P 5/185; H01P 5/187
USPC ..... 333/115, 116, 109
See application file for complete search history.

(56) References Cited

U.S. PATENT DOCUMENTS 3,113,277 A * 12/1963 Casper ..... H01P 5/185 333/116
3,166,723 A 1/1965 Bock et al.
3,617,952 A * 11/1971 Beech ..... H01P 5/185 333/116
4,139,827 A * 2/1979 Russell ..... H01P 5/185 333/116

(Continued)

FOREIGN PATENT DOCUMENTS

DE 38 53 333 11/1995
DE 695 09 571 1/2000

(Continued)

OTHER PUBLICATIONS

International Search Report for PCT/EP2015,000451, dated Jun. 1, 2015, 6 pages.

(Continued)

*Primary Examiner* — Dean O Takaoka
(74) *Attorney, Agent, or Firm* — Nixon & Vanderhye P.C.

(57) ABSTRACT

An improved multi-stage broadband directional coupler with at least one line junction between two successive coupling sections has a) a change in the line thickness (LD) and/or b) a change in the line width (LB) and/or c) a change in the coupling distance (KA) between the adjacent coupling sections of the two coupling lines. An electrically conductive cover connected to the coupler housing is provided adjacent to the at least one line junction.

16 Claims, 5 Drawing Sheets

(56) References Cited

U.S. PATENT DOCUMENTS

| | | | | |
|---|---|---|---|---|
| 4,459,568 | A * | 7/1984 | Landt | H01P 5/187 333/116 |
| 4,797,643 | A | 1/1989 | Wong et al. | |
| 5,499,001 | A * | 3/1996 | Degun | H01P 5/187 333/115 |
| 5,823,791 | A | 10/1998 | Bellantoni et al. | |
| 6,822,532 | B2 * | 11/2004 | Kane | H01P 5/187 333/115 |
| 6,946,927 | B2 | 9/2005 | Allen et al. | |
| 2004/0017267 | A1 | 1/2004 | Kane et al. | |

FOREIGN PATENT DOCUMENTS

| | | |
|---|---|---|
| EP | 0 669 671 | 8/1995 |
| EP | 1 867 003 | 12/2007 |
| JP | 05191113 | 7/1993 |

OTHER PUBLICATIONS

Fahmi et al., "Multilayer Multi-Section Broadband LTCC Stripline Directional Couplers", Microwave Symposium, 207, IEEE/MTT-S International, IEEE, Jun. 1, 2007, pp. 173-176.

Zinke et al., "Hochfrequenztechnik 1", Springer Verlag, 6, Aulage 2000, 3 pages.

English translation of Search Report dated Jun. 27, 2018, issued in Chinese Patent Application No. 201580014965.9.

Microwaves101.com, Mitered Bends, retrieved Nov. 9, 2018, 14 pages.

* cited by examiner

MULTI-STAGE BROADBAND DIRECTIONAL COUPLER

CROSS-REFERENCE TO RELATED APPLICATIONS

This application is the U.S. national phase of International Application No. PCT/EP2015/000451 filed 26 Feb. 2015, which designated the U.S. and claims priority to DE Patent Application No. 10 2014 004 007.0 filed 20 Mar. 2014, the entire contents of each of which are hereby incorporated by reference.

STATEMENT REGARDING FEDERALLY SPONSORED RESEARCH OR DEVELOPMENT

None.

FIELD

The invention relates to a multi-stage broadband directional coupler.

In high-frequency systems, it is often necessary to split a signal, for example of a power P, into two signals in any given power split. In special cases, it may be desirable to split the power into 50% in each case. Hybrid ring couplers are often used for this purpose. Hybrid ring couplers of this type are known inter alia from Zinke Brunswig "Hochfrequenztechnik", Springer-Verlag, $6^{th}$ edition, 2000, in particular page 192.

BACKGROUND AND SUMMARY

These hybrid ring couplers are frequently constructed using microstrip conductor technology.

Further, however, high-frequency couplers are also known in which the degree of coupling is generally set via lines coupled on the end or longitudinal faces. For higher coupling levels, such as are required for a power splitter, these distances are often very small, or even so small that they can no longer be produced economically.

Thus, for example, a directional coupler is also known from U.S. Pat. No. 6,946,927 B2, which is constructed using suspended substrate technology. In other words, a coupling path using stripline technology is provided on one side of a substrate and is connected to two first and second terminals, also constructed using stripline technology, on the substrate. On the opposite side of the substrate, a second coupling path is further arranged, which leads to a third and fourth output or terminal. In a plan view, the two coupling paths are arranged so as to overlap at least in part.

A high-frequency coupler which is even further improved, in particular in the form of a narrow-band coupler or power splitter, is known for example from EP 1 867 003 B9. According to this publication, an improvement is also achieved by providing interdigital capacitors, which are each coupled between a coupling path and the earth, in the longitudinal direction of the two coupling paths.

The main drawbacks of the directional couplers using coplanar line technology relate inter alia to the required minimum distances between the conductor paths coupled on the longitudinal faces and to the coupling factor, which is thus also limited. Further, the coupling factor is highly tolerance-dependent (etching tolerances and fluctuations in the dielectric constant of the substrate material have a disadvantageous effect). Further, a coupler using coplanar line technology is non-optimal as regards dielectric losses.

An ideal separation of forward and backward waves is additionally only possible using directional couplers which permit propagation of TEM waves. Directional couplers using microstrip conductor or coplanar line technology do not make propagation of pure TEM waves possible. Therefore, directional couplers using coaxial line technology are used.

However, directional couplers or power splitters using coaxial line technology are of a relatively complex construction. Thus, in conventional directional couplers of this type, extremely precisely milled housings have to be manufactured, which have to have very different housing interior widths for the different stages of the coupler. Thus, the arrangement, in particular at the transition from one coupling stage to the next, is highly critical, since precise dimensions have to be adhered to here both as regards the coupling lines and as regards the distance from the inner housing walls. Even minimal deviations here can lead to relatively strongly altered electrical characteristic values.

A directional coupler largely similar to the described prior art is also known from EP 0 669 671 A1. It comprises two coupling paths, which each extend between two terminals on different paths. Each of the two coupling paths has a coupling portion, the two coupling paths extending mutually in parallel at a predetermined distance in the region of the respective single coupling portions thereof, so as to produce the desired coupling effect in this case.

An arrangement which is comparable in this regard is also known from U.S. Pat. No. 4,797,643. The special feature in this case is that two directional coupler arrangements which produce a coupling effect are arranged in a shared housing. The actual coupling path is formed by two coupling portions that extend perpendicularly at a distance from one another and belong to the two coupling paths.

After passing through an intermediate path approximately ten times as long as the coupling portion, the two coupling paths cross a second time. At this second crossing point, the two coupling paths likewise again extend at an equal distance from one another, and form the next two interacting coupling portions there.

JP 5-191113 discloses a directional coupler in which each coupling path has just one coupling portion between the respectively associated terminals thereof, which portion interacts with a corresponding coupling portion, extending in parallel therewith, of the second coupling path.

The prior publication MOHAMED M FAHMI: "Multilayer Multi-Section Broadband LCC Stripline Directional Couplers", 1 Jun. 2007, XP031111873, describes a coupler device, specifically a directional coupler having four terminal ports. However, this is a stripline coupler which is fundamentally of a completely different construction from the above-described coaxial couplers, which have intercoupled signal lines accommodated in a housing which serves as an external conductor.

Against this background, the object of the present invention is to provide an improved directional coupler, in particular a 3 dB coupler, which is improved by comparison with conventional solutions in terms of costs, losses and manufacturing tolerances.

The object is achieved according to the invention in accordance with the features set out in claim 1. Advantageous embodiments of the invention are set out in the dependent claims.

The directional coupler according to the invention has major advantages over the prior art.

The directional coupler according to the invention is distinguished primarily by having a low tolerance-sensitivity whilst maintaining very good electrical values. In addition, the housing of the coupler according to the invention can be produced in a convenient manner. Overall, the coupler according to the invention is simple to manufacture and calibrate, making possible manufacture which is more cost-effective overall than conventional solutions.

The directional coupler according to the invention comprises a housing as an external conductor, which may preferably be manufactured as an injection-moulded part. Although injection-moulded parts of this type undergo or have to undergo subsequent machining in relation to the housing interior, the manufacture of an injection-moulded housing of this type is much more cost-effective than a housing which previously had to be milled in accordance with the prior art. The housings previously had to be milled because directional couplers of this type were highly tolerance-dependent, and the required precision could only be adhered to using a milled housing.

Further, the directional coupler according to the invention is distinguished in that the coupling portions of the two coupling paths of the multi-stage broadband directional coupler are defined with respect to one another by transition regions, which are also referred to as discontinuities for simplicity, even though the transition need not be exactly abrupt but rather takes place gradually over some distance. At these transition points, the coupling portions have an altered line cross section, i.e. the line thickness and/or line width thereof changes and/or the coupling distance changes, i.e. the distance between the two adjacent but galvanically separated coupling lines. Subsequently, capacitively acting shields are provided in the interior of the coupler housing in this region as a compensation device for the aforementioned transition regions.

In the context of the invention, it is thus ultimately also possible for the coupler housing to be able to have a more or less equal housing interior width over the coupling path or for this housing interior width only to vary relatively little over the length of the housing. In conventional multi-stage directional couplers, the housing interior width varies greatly in relation to the individual coupling portions. It was perfectly normal for the housing interior width to have to be configured 2 to 3 times larger from an initial coupling portion to a subsequent or central coupling portion. The interior ratios and dimensions still had to be adhered to extremely precisely, in particular at the transition regions from one coupling portion to the next.

In a preferred embodiment of the invention, it is further possible for the coupling distance, in particular between the coupling portions positioned closest together, to subsequently be able to be fine-tuned slightly by the possibility of inserting and/or fixing dielectric spacers (for example in the form of a plastics material plate etc.), which may be of small dimensions, between the coupling portions positioned closest together.

Also, one or the many further advantages in the context of the invention is that the coupler housing can be separated into two equal coupler housing halves along a separating plane. Each of the two coupler housing halves comprises one of the basically two coupling paths. Thus, each housing half can be mounted along with the associated coupling path, and subsequently the complete coupler housing can be finished by putting the two coupler housing halves together.

Further advantages, details and features of the invention can be seen in the following from the embodiment described by way of drawings, in which, in detail:

Figure 1:
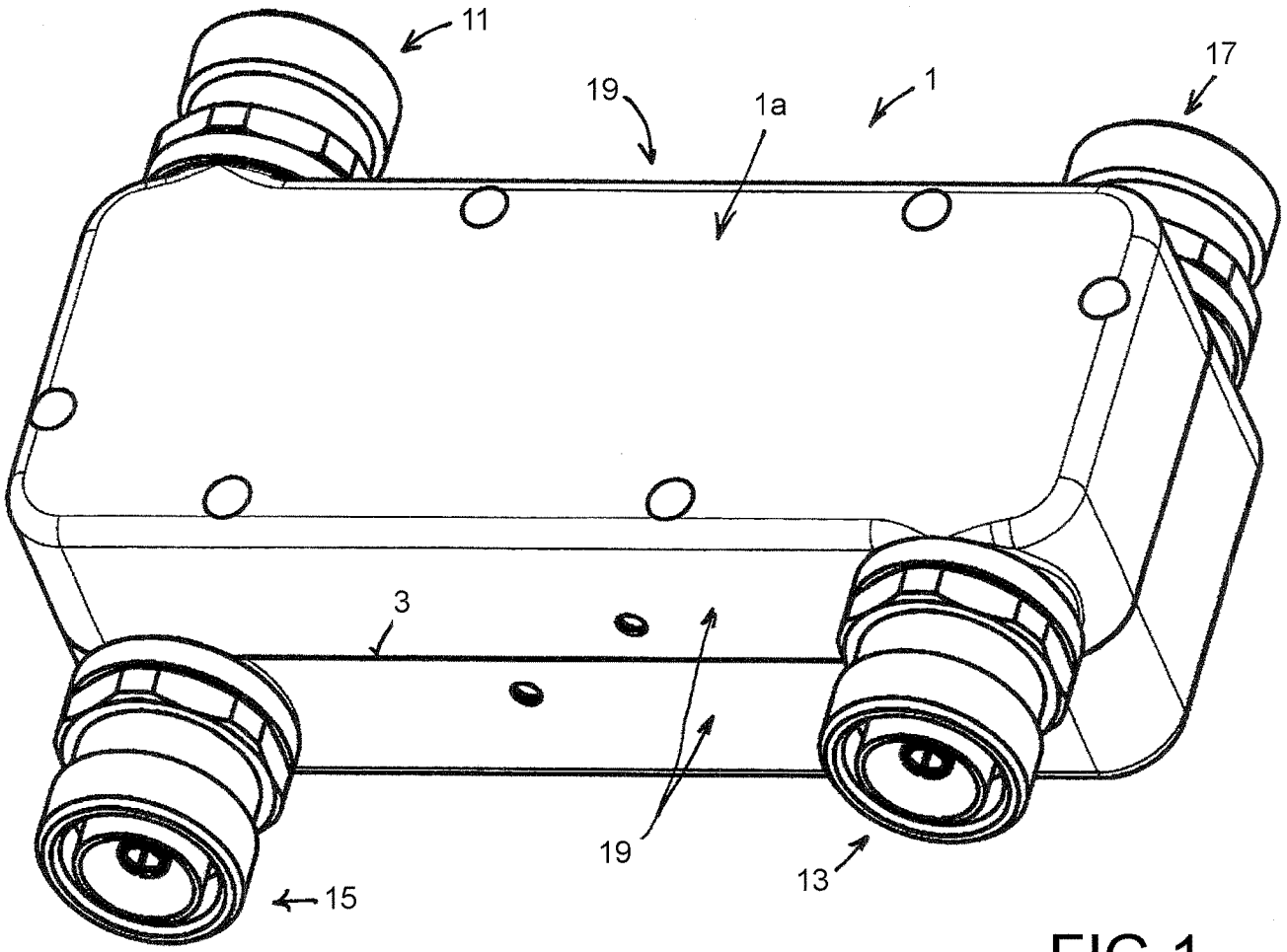
FIG. 1 is a first perspective view of a directional coupler according to the invention having a closed directional coupler housing.

The multi-stage directional coupler shown in the drawings is formed for example as a 3 dB directional coupler. However, the coupling path may also be configured differently, in such a way that power splits other than 50:50 are also possible at any time.

DETAILED DESCRIPTION OF NON-LIMITING EMBODIMENTS

The drawings show the directional coupler according to the invention having a coupler housing 1, which in the embodiment shown comprises coupler housing halves 1*a* and 1*b* formed identically in terms of size.

In other words, the two coupler housing halves 1*a*, 1*b* are of the same length, the same width and the same height transverse to the separating plane 3 thereof.

Two adjacent coupler housing halves 1*a* and 1*b*, visible from the opening faces 5 thereof, are formed identically (or formed substantially identically) and can be placed with the opening faces 5 thereof against one another by rotation through 180°, in such a way that the housing half contact planes 7, each positioned at the separating plane 3, of the two coupler housing halves 1*a*, 1*b* come to be positioned against one another, including the coupling path (discussed further below) provided in the housing interior 9.

Like any directional coupler, the directional coupler comprises at least three ports, but generally four ports. In the embodiment shown, a coaxial interface 11, 13, 15, 17 visible on the housing exterior is provided in each of the ports, each coupler housing half 1*a*, 1*b* having a coaxial interface 11, 13 or 15, 17 on each of the two opposing longitudinal faces 19. Equally, however, corresponding lines connected in the interior of the housing, in particular coaxial cables, may also be guided out of the housing. For simplicity, reference is made to ports in this case too. The two coaxial interfaces 11, 13 associated with one of the two coupler housing halves 1*a*, 1*b* form the two ports, which are connected to one of the coupling paths described in the following, whilst the other two coaxial plug couplings 15, 17, which are provided on the other coupler housing half 1*b*, are connected to the second coupling path. Generally speaking, the connection of the coupling paths at the ends thereof is ultimately provided by way of a coaxial line system, for example in the form of a coaxial line.

As is known, the electrical mode of operation is such that an electromagnetic wave input at one coaxial coupling plug is output at the two opposite coaxial plug couplings forming the outputs with a corresponding power split, in accordance with the coupling ratio, whereas ideally no energy is output at the remaining fourth port on the input side.

Figure 2:
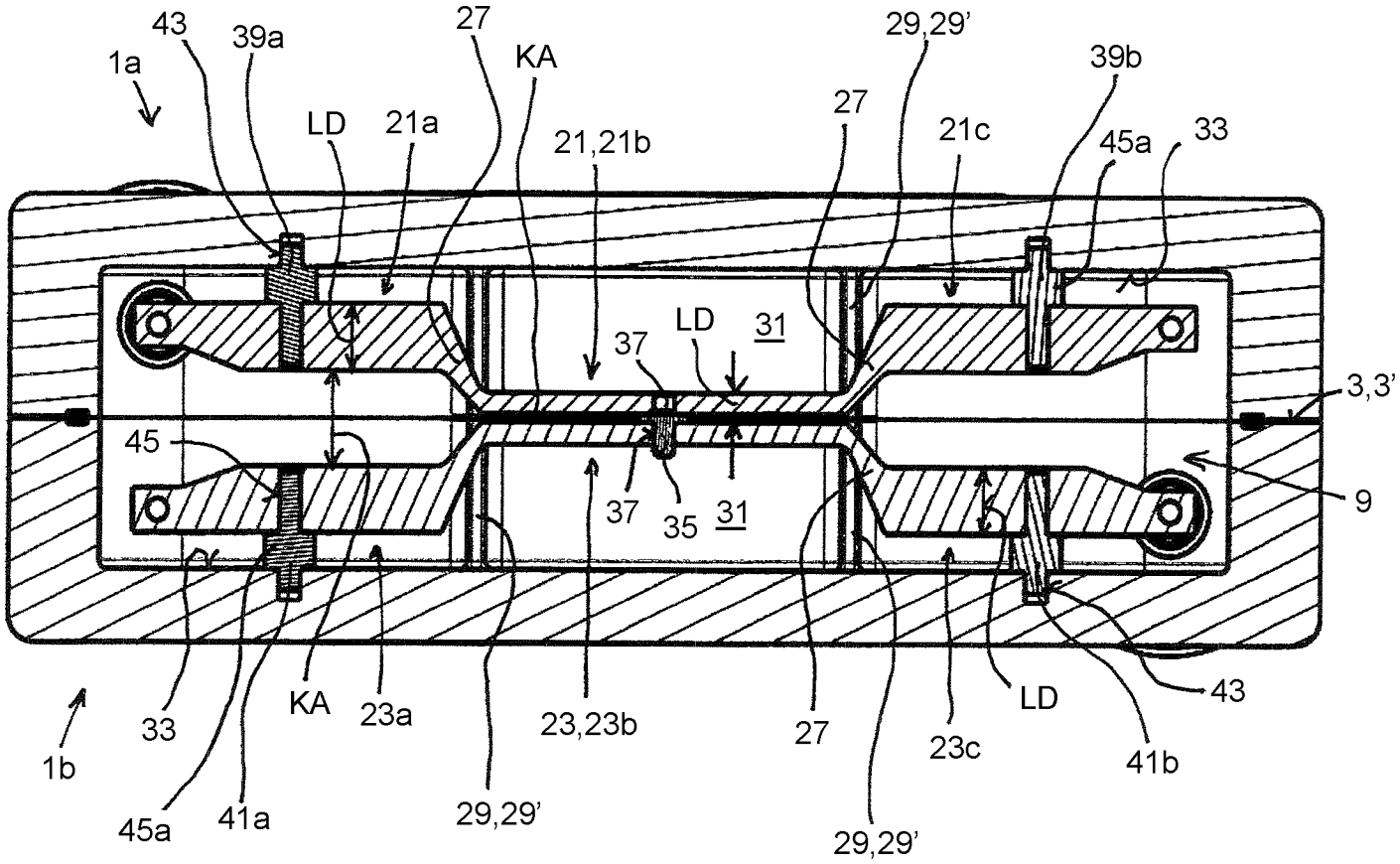
FIG. 2 is a vertical longitudinal sectional view through the directional coupler according to the invention.
Figure 3:
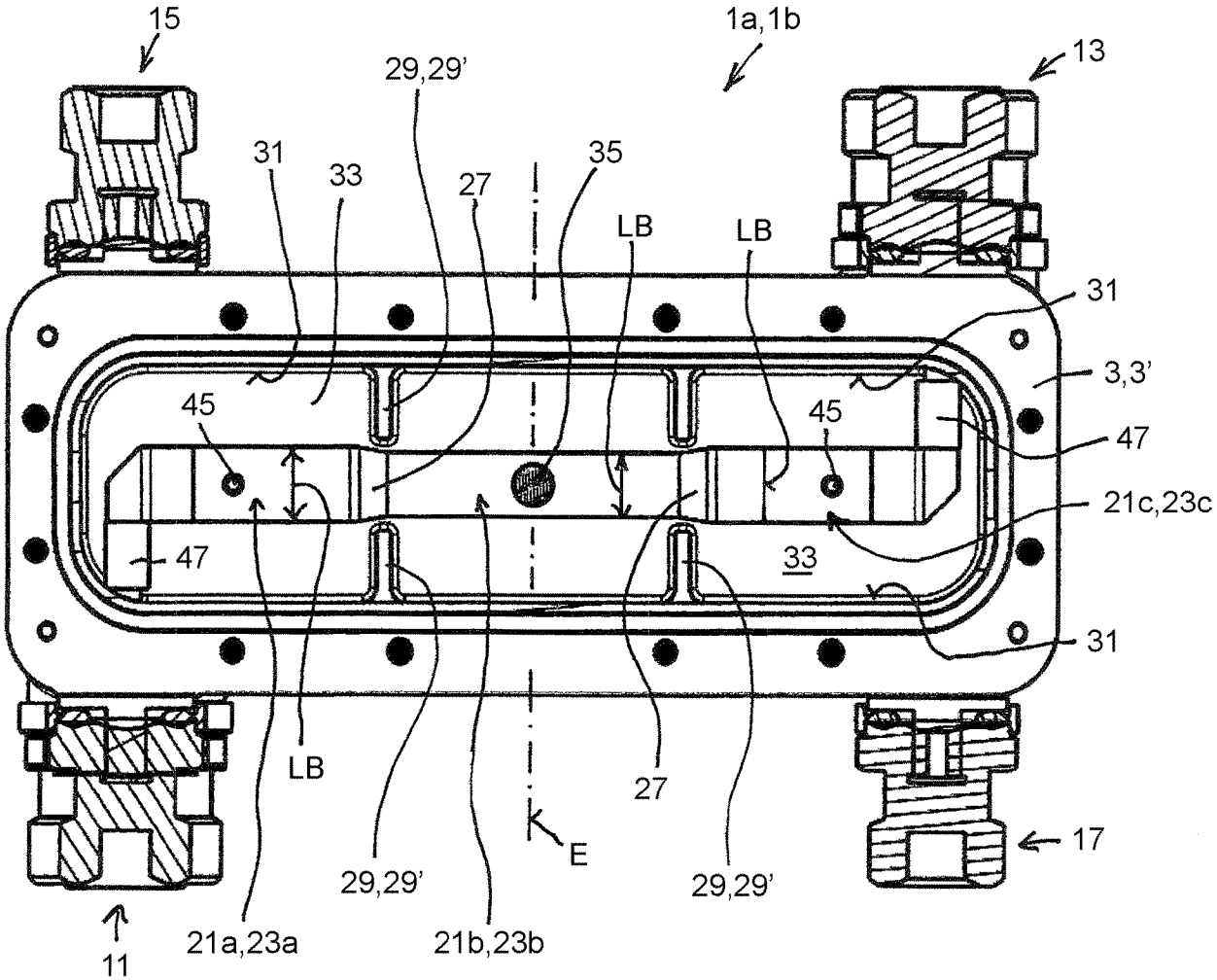
FIG. 3 is a horizontal longitudinal sectional view through the directional coupler according to the invention at the level of the two housing halves touching one another at the centre.

From the cross-sectional view of FIG. 2, extending through the housing and through the coupling path in the longitudinal direction, and the longitudinal sectional view of FIG. 3 at the separating plane 3, the construction of the directional coupler according to the invention can be seen, in particular including in the interior. For example, FIG. 3 shows the upper directional coupler housing half 1*a*, including a view of the interior, the second coupler housing half 1*b* being of identical construction in this regard. Therefore, FIG. 3 gives the corresponding reference numerals for the associated coupling paths, coupling portions etc. both of the first housing half 1*a* and of the second housing half 1*b*, even though only one coupler housing half having one coupling path is shown.

From the drawings, it can be seen that the two coupling paths 21 and 23 are of a multi-stage construction, and in the embodiment shown are subdivided into three coupling portions, specifically coupling portions 21*a*, 21*b* and 21*c* for the first coupling path 21 and corresponding coupling portions 23*a*, 23*b* and 23*c* for the second coupling path 23.

The first and third coupling portion of each coupling path 21, 23 are each configured symmetrically about a central vertical plane E, at least over the majority of the length thereof.

Each of the coupling portions has a line width LB and a line thickness LD (perpendicular to the plane 3 in a vertical direction), in other words a specific material cross section. In addition, in each case each of the three coupling portions is characterised by a coupling distance KA between the two adjacent coupling portions 21*a* and 23*a* or 21*b* and 23*b* or 21*c* and 23*c*.

Transition regions 27, in which the material cross section of the coupling paths 21, 23, i.e. the coupling width and/or the coupling thickness and/or the coupling distance between the two adjacent coupling portions changes, are formed between the successive coupling portions 21*a*, 21*b*, 21*c* or 23*a*, 23*b*, 23*c* of each of the two coupling paths 21, 23.

The length of the individual coupling portions substantially corresponds at least approximately to $\lambda/4$ for the mid-band operating frequency of the coupler.

Figure 5:
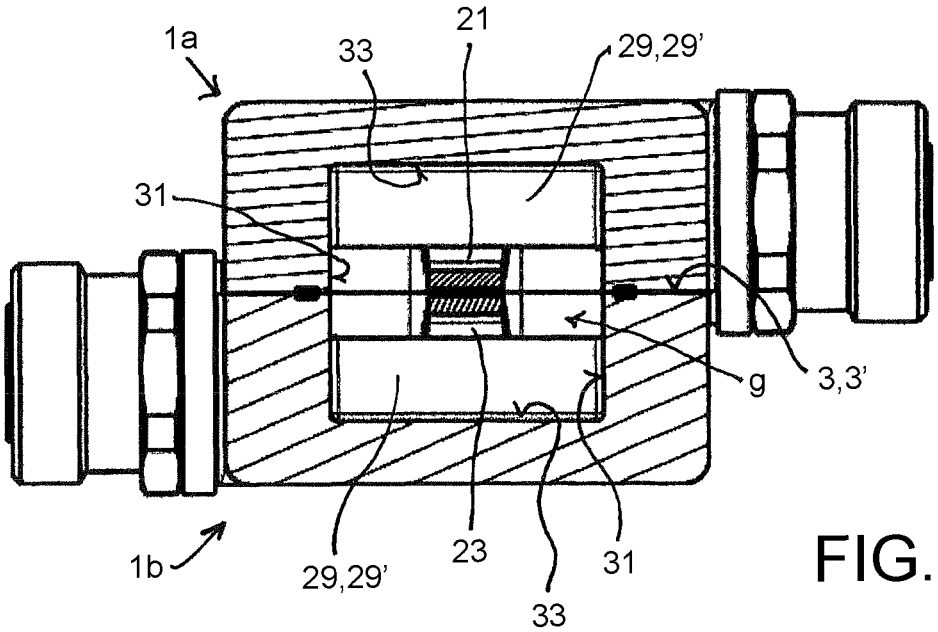
FIG. 5 is a sectional view corresponding to FIG. 4 but for an embodiment differing from FIG. 4 and having differently formed shields.
Figure 6:
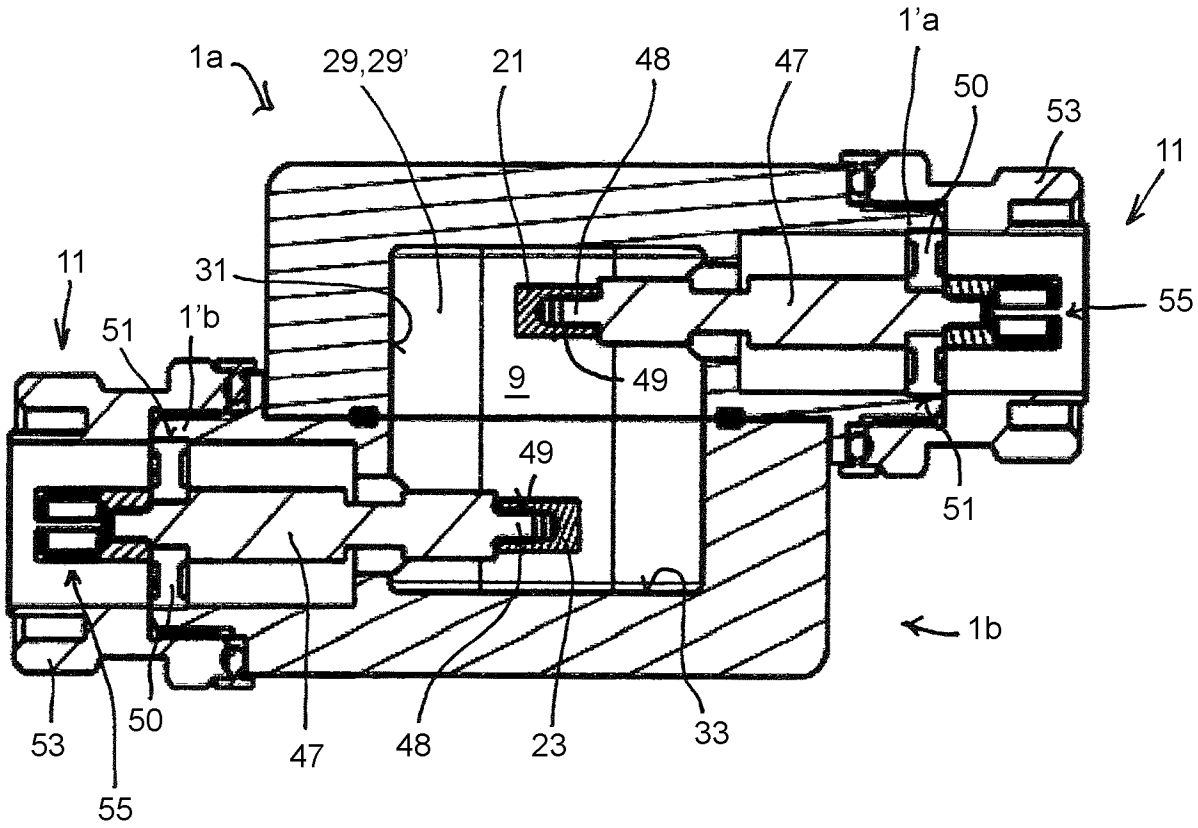
FIG. 6 is a cross-sectional view along the line C-C in FIG. 3.

Further, it can also be seen from FIGS. 5 and 6 that shields 29 are formed in the housing interior 9 in the transition region 27 between the individual successive coupling portions. These shields 29 are formed as shield webs 29', which are orientated to extend transversely and in particular perpendicularly to the longitudinal inner faces 31 of the housing interior 9 and thus more or less perpendicularly to the longitudinal direction L of the coupler housing 1 and thus of the coupling paths 21, 23.

In the embodiment shown, two shield webs 29' are provided for each transition region 27, and each protrude from two opposing longitudinal inner faces 31 in the housing interior 9 in the direction of the coupling path 21, 23, preferably protruding perpendicularly from the longitudinal inner faces 31 and ending in the transition region 27 at a small distance from the side flanks (side wall portions) of the relevant coupling path.

These shield webs 29' may each extend as far as the base 33 of the relevant coupler housing half 1*a*, 1*b* defining the housing interior 9, where they are connected to the material of the associated housing half 1*a*, 1*b*, in particular in a material fit. However, it is also possible for the shields or shield webs 29, 29' to end before the base 33 or the base face 33 formed thereby so as to form a gap.

The shields 29 visible in the drawings, i.e. the shield webs 29', end at least shortly before the separating plane 3, in other words the peripheral housing edge 3', in such a way that the two housing halves can be joined together securely, lying against one another at the peripheral housing rim 3' thereof.

Figure 4:
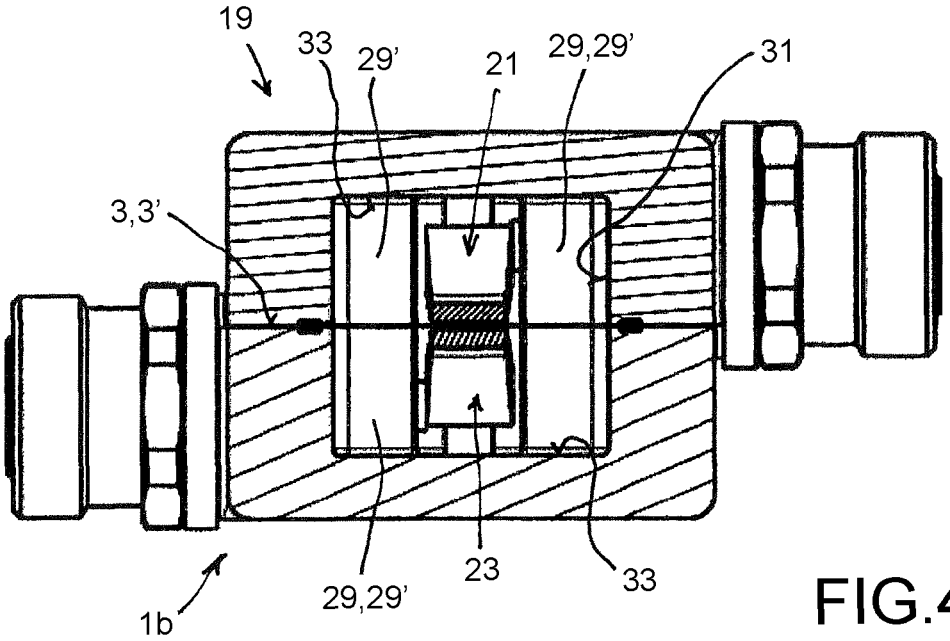
FIG. 4 is a cross-sectional view along the line A-A in FIG. 2.

In addition or alternatively, the shields 29 may also be formed in such a way that the shield webs 29' are not arranged to the side of the coupling paths 21, 23 which are arranged above one another (as shown in FIGS. 2, 3, 4 and 5), but instead are formed extending above and below the lower and upper coupling paths 21, 23, as is shown in FIG. 5, which is different from FIG. 4. The shields 29 and shield webs 29' shown in FIG. 5 thus extend transversely and preferably perpendicularly to the inner side faces 31 of the respective coupler housing half 1*a*, 1*b* and are thus rigidly connected to the respective coupler housing halves 1*a*, 1*b* integrally over the entire width of the interior 9. These shields, shown in FIG. 9, thus do not extend over the separating plane 3 between the two housing halves, but rather only in the respective housing half.

As can be seen from the plan view of each of the coupler housing halves 1*a*, 1*b*, the housing interior 9 for each of the two coupler housing halves 1*a*, 1*b* is configured with more or less the same interior width IB over the length of the housing interior 9. The inner and longitudinal faces 31 which define the housing interior 9 only transition into inner end faces 32 at the end-face regions of the housing interior, specifically preferably via rounded wall portions 34.

Since, unlike in the art, the housing according to the invention thus more or less has an evenly formed housing interior width IB over the entire interior length thereof, the housing according to the invention or the coupler housing halves according to the invention may also be formed as cast parts. In this case, the housing inner faces and the base face can be post-machined if necessary. As a result of this, and also as a result of the lower tolerance-sensitivity than in conventional solutions, it is possible to use a coupler housing manufactured as a cast part.

The coupling level can be influenced and changed by the formation of the coupling paths, i.e. by corresponding changes of cross section in the individual coupling portions and/or by changes in the coupling distance KA, in particular between the two coupling portions extending closest together, i.e. between the two central coupling portions 21*b* and 23*b* in the embodiment shown.

In this case, so as to carry out precise distance tuning and/or to change the coupling factor if desired, an insulator or dielectric 35 may be interposed at this point, optionally inserted into a hole so as to be held captively. A spacer rim of the insulator, protruding beyond the hole 37 in the coupling portion 21*b* or 23*b*, thus defines the minimum distance between the two coupling portions 21*b*, 23*b*.

In the embodiment shown, the two coupling paths 21, 23 are each held by way of two spacers or support devices in the form of an insulator or dielectric, specifically spacers or support devices 39*a* and 39*b* for the first coupling path 21 and spacers or support devices 41*a* and 41*b* for the second coupling path 23. These support elements 39*a*, 39*b* and 41*a*, 41*b* for holding and adjustment may for example be pin-shaped, and are inserted into corresponding internal housing holes 43, opposing shoulders of the support elements engaging in corresponding coupling portion holes 45. In turn, a material shoulder 45*a* protruding radially beyond the hole diameter is provided therebetween, and is positioned both on the base face of the respectively adjacent base 33 of the coupler housing half 1*a*, 1*b* and on the coupling portion base face 25 adjacent thereto, as can be seen in particular from FIG. 5. In each case, the two coupling paths are connected via an internal conductor connection piece 47 (FIG. 6), which is preferably provided with a connection shaft 48, which is provided with an external thread and in accordance with the drawing of FIG. 6 can be screwed into a transverse hole 49, provided with an internal thread, at the end of the respectively associated coupling portion 21*a*, 21*c* or 23*a*, 23*c*.

This internal conductor connection piece 47 is subsequently held in a braced manner by means of an insulator plate 50 against a housing hole 51, in the axial extension of which the external conductor 53 of the associated coaxial interface 11 is arranged, preferably being screwed on by way of a threaded connection on the associated coupler housing half, i.e. a housing shoulder 1'*a* or 1'*b* integrally connected to the coupler housing half there. In the region of the outwardly facing coaxial interface 11, the associated internal conductor connection piece 47 is configured for example in the form of a coaxial plug coupling in the manner of a conventional internal conductor 55 which makes a coaxial plug-in connection possible. However, in a deviation from this, a coaxial cable connection may also for example be guided out to the outside directly from the interior of the housing 9 or of the housing half 1*a* or 1*b*, without the aforementioned interface formation. Completely different configurations and solutions are also possible in this regard.

As a result of this arrangement, in principle each of the two coupling paths 21, 23 can be held in the associated coupler housing half 1*a*, 1*b* even without the aforementioned spacers or support elements 39*a*, 39*b* or 41*a*, 41*b*.

The broadband coupler according to the invention has been described with reference to two coupling paths, which are each subdivided into three coupling portions, as well as the two transition regions each between two successive coupling regions. However, in a deviation from this, more or fewer coupling portions may also be provided in each of the coupling paths. In principle, whilst taking into account the configuration according to the invention, a coupler may also be implemented which for example only comprises two coupling paths, which are each subdivided into two successive coupling portions only having one interposed transition region. Likewise, the coupling paths may also have more than three coupling portions, for example 4, 5 etc. coupling portions in succession, which are preferably likewise distinguished by corresponding transition regions of varying material cross section and/or by a coupling distance changed to this effect between two successive coupling portions.

Additionally, an advantage of the directional coupler according to the invention is that two coupler housing halves of the same dimensions can be used. They may preferably both consist of a cast part. However, it is also possible to use a coupler housing of a height in which both coupling paths can be accommodated. This coupler housing may also preferably consist of a cast part, for example of an aluminium cast part. In this case, all that would remain would be to place a possibly planar cover on the opening face 9 of the box-shaped coupler housing. In this case, a cover of this type need not necessarily consist of a cast part.

The invention claimed is:

1. Multi-stage broadband directional coupler comprising:

two coupling paths each having at least two successive coupling portions, a coupler housing as an external conductor, the two coupling paths being accommodated in a coupler housing interior, a line transition between the at least two successive coupling portions, each of the coupling portions having a line width and a line thickness, a coupling portion of one coupling path being positioned at a coupling distance from an adjacent coupling portion of the other coupling path, between the respectively successive coupling portions of the two coupling paths, a transition region is formed, in which the material cross section of the coupling path, i.e. the line width and/or the line thickness and/or the coupling distance between a coupling portion of one coupling path and an adjacent coupling portion of the other coupling path changes, and an electrically conductive shield connected to the coupler housing and provided adjacent to the at least one line transition, the shield comprising plural webs adjacent to the at least one line transition, the plural webs each being at least one of:

(a) formed or arranged on the inner longitudinal faces of the coupler housing and extending past the two coupling paths arranged above one another to the side thereof and at a distance therefrom, and (b) connected to the associated base of the coupler housing and extending past the respectively adjacent coupling path above or below said coupling path, wherein the interior width of the coupler housing is the same in the region of the successive coupling portions or the interior width deviates by less than 30% over the length of the housing interior.

2. Broadband directional coupler according to claim 1, wherein the shield webs are only connected to the coupler housing at the respectively associated base and/or at the associated inner longitudinal face thereof.

3. Broadband directional coupler according to claim 1, wherein the line transition is of a length in the longitudinal direction of the coupling path which is greater than 1% of an associated coupling portion and/or shorter than 30% of the length of an associated coupling portion.

4. Broadband directional coupler according to claim 1, wherein the interior width deviates by less than 20% over the length of the housing interior, at least excluding the connection points provided at the opposing coupling path ends.

5. Coupler housing according to claim 1, wherein the coupler housing is split into two coupler housing halves along a separating plane.

6. Broadband directional coupler according to claim 5, wherein the coupler housing halves are formed identically or substantially identically, one coupling path being accommodated and held in the first coupler housing half and the other coupling path in the second coupler housing half.

7. Broadband directional coupler according to claim 1, wherein each coupling path is connected at the end thereof to a coaxial line system.

8. Broadband directional coupler according to claim 1, wherein the opposing ends of each coupling path are each rigidly connected to an internal conductor connection piece, which extends through the coupler housing and forms an internal conductor terminal of a coaxial line system in the region of the coupler housing.

9. Broadband directional coupler according to claim 7, wherein the internal conductor connection piece is held in a braced manner in a housing hole in the coupler housing and in the coupler housing half by an insulator piece in the form of an insulator plate.

10. Broadband directional coupler according to claim 9, wherein each of the two coupling paths is held with respect to the coupler housing by way of the internal conductor connection pieces linked to the coupling path ends and by way of the insulator pieces.

11. Broadband directional coupler according to claim 1, wherein to brace the two coupling paths, in each case at least two support devices, mutually offset along the coupling path, are provided, and are positioned in the housing interior of the coupler housing and in the coupler housing halves and the associated coupling portions.

12. Broadband directional coupler according to claim 1, wherein a spacer that consists of a dielectric and limits the coupling distance in terms of a minimum value, is provided between the coupling portions arranged closest together.

13. Broadband directional coupler according to claim 1, wherein the coupler housing, which is equipped with the housing interior and in which the two coupling paths are accommodated, is formed from a cast part.

14. Broadband directional coupler according to claim 1, wherein the coupler housing comprises two identically or comparably formed coupler housing halves, one coupling path being accommodated and mechanically held in one coupler housing half and the other coupling path being accommodated and mechanically held in the other coupler housing half.

15. Broadband directional coupler according to claim 1, wherein the coupling paths are maintained with respect to the coupler housing by way of insulating support elements.

16. Multi-stage broadband directional coupler comprising:

a coupler housing comprising an external conductor and defining an interior having a length and a width, first and second coupling paths disposed in the coupler housing interior, the first coupling path comprising plural successive first path coupling stages with a first line transition therebetween, the second coupling path comprising plural successive second path coupling stages with a second line transition therebetween, an electrically conductive shield connected to the coupler housing and provided adjacent to the at least one of the first and second line transitions, the shield comprising plural webs adjacent to the first and second line transitions, the plural webs each being:

(a) formed or arranged on the inner longitudinal faces of the coupler housing and extending past the two coupling paths arranged above one another to the side thereof and at a distance therefrom, or (b) connected to the associated base of the coupler housing and extending past the respectively adjacent coupling path above or below said coupling path, each of the first path coupling stages and the second path coupling stages having a line width and a line thickness, a said first path coupling stage being positioned at a coupling distance from an adjacent a said second path coupling stage, the coupler housing interior width being the same in the region of the plural successive first and second path coupling stages or deviating by less than 30% over the housing interior length, and a transition region formed between the first and second coupling paths, the material cross section of the first coupling path comprising the line width and/or the line thickness and/or the coupling distance between the said first path coupling stage and the said adjacent second path coupling stage being non-constant.

* * * * *